US007041911B2

(12) United States Patent
Marin Palacios et al.

(10) Patent No.: US 7,041,911 B2
(45) Date of Patent: May 9, 2006

(54) AMORPHOUS MICROWIRE AND METHOD FOR MANUFACTURE THEREOF

(75) Inventors: Pilar Marin Palacios, Madrid (ES); Antonio Hernando Grande, Madrid (ES); Pedro Antonio Agudo Madurga, Madrid (ES); Daniel Cortina Blanco, Madrid (ES)

(73) Assignee: Micromag 2000, S.L., (ES)

( * ) Notice: Subject to any disclaimer, the term of this patent is extended or adjusted under 35 U.S.C. 154(b) by 26 days.

(21) Appl. No.: 10/962,038

(22) Filed: Oct. 8, 2004

(65) Prior Publication Data

US 2005/0077073 A1 Apr. 14, 2005

(30) Foreign Application Priority Data

Oct. 9, 2003 (ES) ..... 200302352

(51) Int. Cl.
*H01B 7/00* (2006.01)

(52) U.S. Cl. ..... 174/110 R; 174/122 G

(58) Field of Classification Search ..... 174/110 R, 174/122 G, 124 G; 340/572.1, 551, 552; 140/300, 304

See application file for complete search history.

(56) References Cited

U.S. PATENT DOCUMENTS 6,441,737 B1 * 8/2002 Antonenco et al. ..... 340/572.1
2005/0120749 A1 * 6/2005 Adar et al. ..... 65/59.6

* cited by examiner

*Primary Examiner*—Chau N. Nguyen
(74) *Attorney, Agent, or Firm*—Ostrolenk, Faber, Gerb & Soffen, LLP

(57) ABSTRACT

An amorphous microwire coated with an insulating sleeve, composed of a metal core made up of an alloy of transition metals and metalloid elements, at a proportion between 65%–90% and 10%–35%, respectively, and an insulating glass sleeve, the transition metals are at least iron, the relative proportion of iron being between 65%–100% of the total transition metals, and the core diameter (Dc) is comprised between 2 μm and 20 μm, such that the magnetostriction constant (λ) of the metal alloy is comprised between 1 and 30 ppm, and the natural ferromagnetic resonance frequency is comprised between 3 and 20 GHz. The invention also refers to a method for the manufacture of an amorphous microwire.

9 Claims, 3 Drawing Sheets

AMORPHOUS MICROWIRE AND METHOD FOR MANUFACTURE THEREOF

FIELD OF THE INVENTION

The present invention refers to an amorphous metal microwire coated with an insulating sleeve, with certain electromagnetic radiation absorption properties, as well as to a method for the manufacture of such microwire.

The invention is encompassed within the technical field of magnetic materials, also covering aspects of electromagnetism, applicable in the field of magnetic absorbers and sensors, and metallurgy.

BACKGROUND OF THE INVENTION

Numerous applications require eliminating electromagnetic radiation reflections. The large number of electronic systems incorporated in vehicles gives rise to an increase of electromagnetic interferences. This problem includes false images, radar interferences and reduced performance due to the coupling between systems. A microwave absorber may be very effective for eliminating this type of problems. There is even greater interest in reducing the echoing area of certain systems to prevent or minimize detection thereof.

Microwave absorbers are made by modifying the dielectric properties or, in other words, the dielectric constant and magnetic permittivity, or magnetic permeability, of certain materials. The first case involves dielectric absorbers which base their operation on the principle of resonance at one-fourth of the wavelength. However, the second case involves the absorption of the magnetic component of the radiation. The first attempts made to eliminate reflections include the Salisbury absorbing screen method, the non-resonant absorber, the resonant absorber and resonant magnetic ferrite absorbers. In the case of the Salisbury screen, a screen with a carefully chosen electric resistance is placed at the point where the electrical field of the wave is maximum, i.e. at a distance equal to one-fourth of the wavelength with regard to the surface to be screened. This method has little practical use since the absorber is too thick and is only effective for too narrow a band of frequencies and variation of incident angles.

In the non-resonant methods, radiation crosses through a dielectric sheet to subsequently be reflected by the metal surface. The dielectric sheet is thick enough so that in the course of its reflection, the wave is sufficiently attenuated before reemerging from the sheet. As the sheet must be made of a material having low losses at high frequency and low reflection properties to assure penetration and reflection, the sheet must be very thick to effectively attenuate the wave.

In the first resonant methods, materials with high dielectric losses are placed directly on the conductive surface to be protected. The dielectric material has an effective thickness, measured inside the material, approximately equal to an even number of one-fourths of semi-wavelengths of the incident radiation. The utility of the method is limited due to the substantial thickness of the dielectric sheet and to the narrow absorption band they have, especially at low frequencies. Attempts have been made to make up for these deficiencies by dispersing ferromagnetic conductive particles in the dielectric material. However, when metal particles, high permeabilities, in the range of 10 or 100, disperse, they are not compatible with low conductivities, in the range of $10^{-2}$ or $10^{-8}$ mmhos per meter.

Another type of absorbers are those known as ferrite absorbers (see, for example, U.S. Pat. No. 3,938,152), having clear advantages over those already set forth herein. They function in the form of thin sheets such that they overcome the drawbacks of the substantial thickness required by dielectric absorbers. Furthermore, they are effective for frequencies between 10 MHz and 15,000 MHz, and they dissipate more energy than dielectric absorbers do.

Ferrite absorbers developed hitherto eliminate reflections by means of sheets of insulating or semi-conductive ferrites, and particularly ferromagnetic metal oxides, placed directly on the reflective surface. In these cases, the term ferrite refers to ferromagnetic metal oxides including, but not limited to, spinel, garnet, magnetoplumbite and perovskite type compounds.

In this type, the absorption is of two types, which can occur simultaneously or not. These are dielectric and magnetic losses. The first losses are due to the electron transfer between the cations $Fe^{2+}$ and $Fe^{3+}$, whereas the ones of the second type originate from the movement and relaxation of spins of the magnetic domains.

According to certain inventions (such as U.S. Pat. No. 3,938,152), at low frequencies, generally those in the range between UHF and the L-band, energy is predominantly extracted from the magnetic component of the incident radiation field, whereas at higher frequencies, generally in the L-band and higher, energy is equally extracted from the electric and magnetic component.

This type of absorbers eliminates reflection because the radiation establishes a maximum magnetic field on the surface of the conductor. In the normal incidence of a flat wave on an ideal conductor, complete reflection occurs, the reflected intensity is equal to the incident intensity. Incident and reflected waves come together, then generating a standing wave in which the electric field is nil at the border of the conductor, whereas the magnetic field at that border is maximum. There is a condensation of the magnetic field for the maximum time possible. In this manner, in the case of ferrite, it is necessary for the incident radiation to go through the absorbing sheet to establish the maximum magnetic field conditions. It has been seen that the complex part of the permeability of certain ferromagnetic metal oxides varies with the frequency such that it enables obtaining low reflections on very broad frequency ranges without needing to use magnetic absorbers of substantial thicknesses as in other cases.

Taking into account the reflection coefficient in metals for normal incidence, it is deduced that when working with a thin sheet, the reflected wave can be attenuated regardless of the electric permittivity of the absorbing material. Minimum reflections will occur at a certain frequency if the complex permeability $\mu''$ is substantially greater than the real one $\mu'$ as long as the product $K\tau<<1$, where K is the wave number and $\tau$ is the thickness of the sheet.

The present invention refers to a type of element susceptible of being used in supports for electromagnetic radiation absorption, known as magnetic microwire.

The known Taylor's technique used for the manufacture of microwires enables obtaining them with small diameters comprised between one and several tens of microns. Microwires thus obtained can be made from a large variety of alloys and magnetic and non-magnetic metals. This technique is disclosed, for example, in the article "*The Preparation, Properties and Applications of Some Glass Coated Metal Filaments Prepared by the Taylor-wire Process*", W. Donald et al., Journal of Material Science, 31, 1996, pp. 1139–1148.

The technique for obtaining magnetic microwires with insulating sleeve and amorphous microstructure is disclosed, for example, in the article "*Magnetic Properties of Amorphous Fe_P Alloys Containing Ga, Ge and As*" H. Wiesner and J. Schneider, Stat. Sol. (a) 26, 71 (1974), Phys. Stat. Sol. (a) 26, 71 (1974).

On the other hand, the determination of the manufacturing conditions so that the microstructure of the metal core of the obtained microwire is amorphous are disclosed in U.S. Pat. No. 5,240,066, wherein the ranges within which certain manufacturing parameters must be comprised are disclosed, such as: the superheating temperature of the melted alloy (250–300° C. higher than the melting temperature of the alloy), the length of the cooling area (5–7 mm), the distance from the cooling area to the heating area (40–50 mm), the cooling rate ($10^5$–$10^6$ K/s), etc.

The drawback of the control of magnetic properties such as initial magnetic permeability and magnetic anisotropy field of the metal microwire which, being coated with an insulating sleeve, furthermore has an amorphous structure, according to the manufacturing and processing parameters, have been considered previously in Spanish patent ES 2,138,906, referring to a "Method of Manufacture and Processing of Amorphous Metal Microwires Coated with an Insulating sleeve with High Magnetic Properties" In this case, control of the technical parameters necessary for obtaining microwires with a high real part of magnetic permeability is involved.

Properties of amorphous magnetic microwires with an insulating sleeve are also disclosed in the article "*Natural Ferromagnetic Resonant in Cast Microwires Covered by Glass Insulation*", A. N. Antonenko, S. A. Baranov, V. S. Larin and A. V. Torkunov, Journal of Materials Science and Engineering A (1997) 248–250.

DESCRIPTION OF THE INVENTION

The invention refers to an amorphous microwire and to a method of manufacture of a microwire.

It is an objective of the present invention to provide the compositions, as well as the preparation and processing conditions, of amorphous metal microwires coated with insulating glass having a variable anisotropy field and a bistable hysteresis loop behavior, and as a result, a natural ferromagnetic resonance (NFMR) frequency comprised within a broad range of frequencies associated to those in which the complex part of the permeability is substantially higher than the real part. Control of certain parameters of the manufacturing technique as well as the choice of suitable compositions for the metal core of the microwire enable obtaining a magnetic behavior with a high imaginary part of the magnetic permeability for certain frequencies.

The amorphous microwire coated with an insulating sleeve of the invention consists of:

- a metal core made up of an alloy of transition metals and of metalloid elements at a proportion between 65%–90% and 10%–35%, respectively, and of
- an insulating glass sleeve.

In the microwire of the invention:

- said transition metals are at least iron, the relative proportion of iron being between 65%–100% of the total transition metals, and
- the metal core diameter $D_c$ is comprised between 2 μm and 20 μm, such that the magnetostriction constant λ of the metal alloy is comprised between 1 and 30 ppm, and the natural ferromagnetic resonance (NFMR) frequency is comprised between 3 and 20 GHz.

This magnetostriction constant λ is controlled by means of the relative proportion, within the transition metals, of iron and cobalt, which is preferably another one of the transition metals of the metal core; the higher the amount of iron in the composition of the metal core, the higher the magnetostriction constant.

Another feature of the microwire of the invention is that it has a bistable magnetic behavior, which is characterized by having a critical anisotropy field $H_k$ comprised between 0.5 and 10 Oe.

This critical anisotropy field $H_k$ is controlled on the basis of two items:

- the magnetostriction constant λ: a higher critical field at a higher magnetostriction constant λ;
- the metal core diameter $D_c$: for a certain composition, a larger critical field at a lower core diameter.

In other words, bistable magnetic behavior not only depends on the magnetostriction, but rather it also depends on certain parameters of the microwire manufacturing process, such as, for example, induced stresses.

This dependency occurs through magnetoelastic anisotropy $K=3/2\sigma\lambda$, where σ are such stresses and λ is the magnetostriction constant.

As indicated, the magnetic behavior of the microwire is related to the magnetostriction constant. The magnetoelastic anisotropy value depends on: i) the stresses originated in the manufacturing process, ii) the difference between the dilation coefficients of the glass of the sleeve and of the composition of the metal core, iii) the tensile stress related to the rotational speed of the coil in which the microwire is wound.

On the other hand, the natural ferromagnetic resonance frequency increases with the critical anisotropy field: the greater the critical field, the greater the resonance frequency.

In the microwire of the invention, the core diameter $D_c$ is preferably comprised between 2 μm and 10 μm.

According to a preferred ratio, the proportion of the core diameter $D_c$ to the total diameter $D_t$ of the microwire is comprised between 0.18 and 0.6.

Preferably, the metalloid elements are manganese, silicon, boron and carbon.

More preferably, the composition of the metal core is $Fe_{89}B_1Si_3C_3Mn_4$ or $Fe_{69}B_{16}Si_{10}C_5$.

The inclusion of manganese in the composition of the metal core makes it possible to obtain microwires with a small core diameter $D_c$, as has been indicated, between 2 μm and 10 μm.

The presence of carbon assures more amorphicity than if only silicon and boron were used.

The present invention also refers to a method for preparing microwires that are able to absorb radar radiation in the frequency range comprised between 3 and 20 GHz.

Thus, the method of manufacture of amorphous microwires coated with an insulating sleeve consisting of a metal core and an insulating glass sleeve comprises the following steps:

- arranging a glass tube containing an alloy of transition metals and metalloid elements at a proportion between 65%–90 and 10%–35%,
- melting said alloy by means of an induction coil fed by a generator for a first time ($t_1$) and at a first temperature ($T_1$),
- superheating said melted alloy for a second time ($t_2$) and at a second temperature ($T_2$),
- fusing with the glass tube from the heat generated by the melted and superheated alloy,
- extracting the microwire by means of the capillary winding in coils of the glass with the alloy inside, and
- cooling the microwire, such that the obtained microwire has a magnetostriction constant (λ) comprised between 1 and 30 ppm and a natural ferromagnetic resonance frequency comprised between 3 and 20 GHz.

Preferably, said first time $t_1$ ranges between 1 minute and 5 minutes, and said first temperature $T_1$ ranges between 100° C. and 400° C.

Preferably, said second time $t_2$ ranges between 5 minutes and 60 minutes, and said second temperature $T_2$ ranges between 1200° C. and 1500° C.

BRIEF DESCRIPTION OF THE DRAWINGS

A series of drawings helping to better understand the invention and which are expressly related to an embodiment of said invention, presented as a non-limiting example thereof, is very briefly described below.

DESCRIPTION OF A PREFERRED EMBODIMENT OF THE INVENTION

Figure 1:
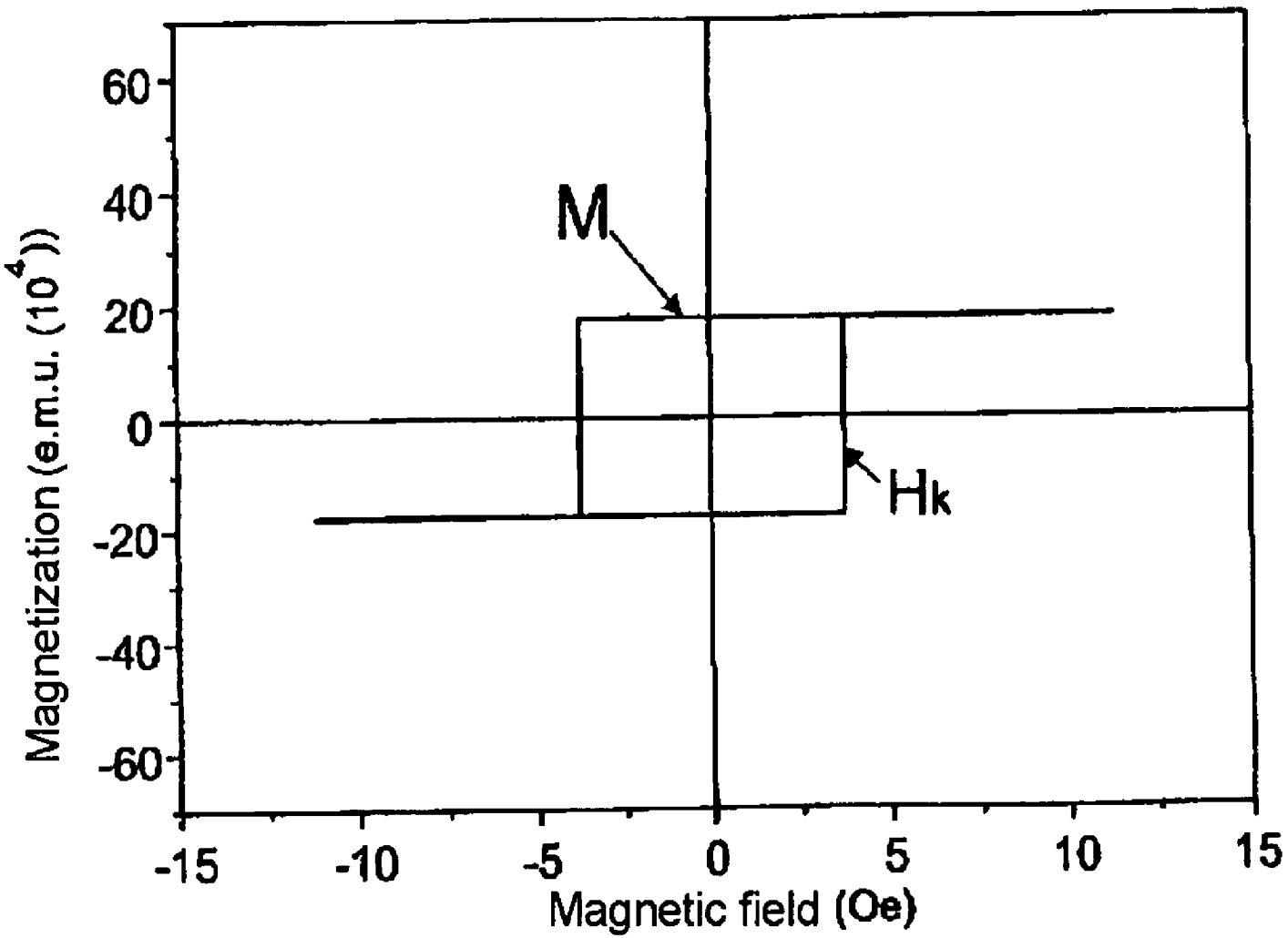
FIG. 1 shows a bistable hysteresis loop and its most important associated parameters.

The microwires of the present invention, as indicated, are made of iron-based alloys and have positive magnetostriction constants λ. Their fundamental magnetic feature is the presence of bistable magnetic behavior characterized by the presence of an abrupt jump of magnetization to practically the saturation magnetization value at a certain value of the applied magnetic field, known as the critical anisotropy field $H_k$.

For a certain composition of the alloy, the critical field of the microwire increases when, the total diameter $D_t$ being maintained constant, the metal core diameter $D_c$ decreases. This is because the larger the ratio between the total diameter and the core diameter, the larger the anisotropy field $H_k$. This effect is due to the fact that during the solidification process, very high stresses occur in the metal core as a result of the different thermal expansion coefficients of glass and metal. Taking into account all these considerations, the anisotropy field can be expressed in the following manner:

$$H_k = \frac{\lambda\sigma_0}{M}\frac{kx}{kx+1}F(k, x)$$

where F(k,x) is a function of k and x, λ is the magnetostriction constant of the alloy, $\sigma_o$ are the stresses induced during the manufacturing process, k is the ratio between the Young's moduli of the glass and metal, respectively, M is the saturation magnetization of the alloy and $$x = \left(\frac{D_t}{D_c}\right)^2 - 1.$$

This longitudinal anisotropy is responsible for the existence of natural ferromagnetic resonance NFMR in amorphous magnetic microwires. The NFMR frequency depends on the magnetic anisotropy value. In known magnetic materials, it is usually 1 GHz. The high values obtained in magnetic microwires are related to high magnetic anisotropies.

Taking into account that the radiation penetration length due to the skin effect in the microwire, δ, is smaller than its radius, and considering the Kittel equations (C. Kittel, Phys. Rev. v. 73, p. 270 (1947)), an expression is obtained in which it is confirmed that the resonance frequency $f_r$ of the microwire depends on its anisotropy field $$f_r = \left(\frac{g^2 M H_k}{\pi}\right)^{1/2}$$

where g is the gyromagnetic constant.

Where appropriate, the materials are used for different applications at high frequencies. Therefore, a reduced magnetic anisotropy field gives rise to a relatively low natural ferromagnetic resonance frequency, between 1 and 3 GHz, whereas a higher anisotropy field gives rise to a resonance frequency between 3 and 29 GHz.

As indicated, the high value of the imaginary part of the magnetic permeability for the chosen frequencies associated to the bistable magnetic behavior with variable anisotropy fields, is controlled by choosing the nominal composition of the alloy, exposure time to the superheating temperature (T), the ratio between the metal core diameter $D_c$ and the total core diameter $D_t$ and the subsequent thermal treatment temperature.

Having chosen the suitable nominal composition, exposure times (t) range between 1 and 5 minutes.

Keeping the exposure time fixed, the anisotropy field increases if the $D_c/D_t$ quotient decreases. By decreasing the exposure time, it is therefore necessary to decrease the internal core diameter to maintain, or in some cases to increase, the anisotropy field $H_k$ and the natural ferromagnetic resonance frequency.

The stresses present in the magnetic metal core can be modified by means of suitable thermal treatments of the samples. The annealings are carried out by induction furnace and in inert atmosphere (Ar). Treatment temperatures must be lower than the crystallization temperatures of the alloy, and they usually range between 100 and 400° C. Treatment times may range between 5 and 60 minutes. These treatments remarkably modify the magnetic properties.

The structure also depends on the temperature of the alloy, which is comprised between 1500 and 1200° C. while it is manufactured and evolves with the mass, which goes from 2.0 to 0.7 g.

The diameter of the microwire is controlled through three fundamental parameters in the manufacturing process, which are: winding speed, vacuum pressure and pyrex tube lowering speed.

As the winding speed and vacuum pressure increase, the metal core diameter decreases. The thickness of the pyrex increases when the pyrex tube lowering speed increases.

The 3 to 20 GHz resonance frequency sweep is carried out in the manner summarized in the following table:

| Composition | Magneto-striction (ppm) | Microwire Geometry (μm) $D_c$ | $D_t$ | Winding Speed (mm/min) | Pyrex tube lowering speed (mm/min) | Vacuum pressure (mmHg) | NFMR (GHz) |
|---|---|---|---|---|---|---|---|
| $Fe_{89}B_1Si_3C_3Mn_4$ | 30 | 2 | 4 | 312 | 2.3 | 180 | 13 |
| $Fe_{89}B_1Si_3C_3Mn_4$ | 30 | 4 | 14 | 305 | 2.3 | 175 | 10 |

-continued

| Composition | Magneto-striction (ppm) | Microwire Geometry (μm) $D_c$ | $D_t$ | Winding Speed (mm/min) | Pyrex tube lowering speed (mm/min) | Vacuum pressure (mmHg) | NFMR (GHz) |
|---|---|---|---|---|---|---|---|
| $Fe_{89}B_1Si_3C_3Mn_4$ | 30 | 6 | 24 | 290 | 2.3 | 170 | 8 |
| $Fe_{89}B_1Si_3C_3Mn_4$ | 30 | 10 | 50 | 280 | 2.2 | 130 | 7 |
| $Fe_{69}B_{16}Si_{10}C_5$ | 28 | 10 | 50 | 280 | 2.2 | 130 | 7 |
| $Fe_{69}B_{16}Si_{10}C_5$ | 28 | 15 | 78 | 275 | 2.1 | 125 | 5 |
| $Fe_{69}B_{16}Si_{10}C_5$ | 28 | 20 | 110 | 270 | 2.1 | 123 | 3 |

As a sample of the features and properties of the microwire of the invention, FIG. 1 shows a bistable hysteresis loop and its most important associated parameters, where M is the saturation magnetization and $H_k$ is the anisotropy field.

Figure 2:
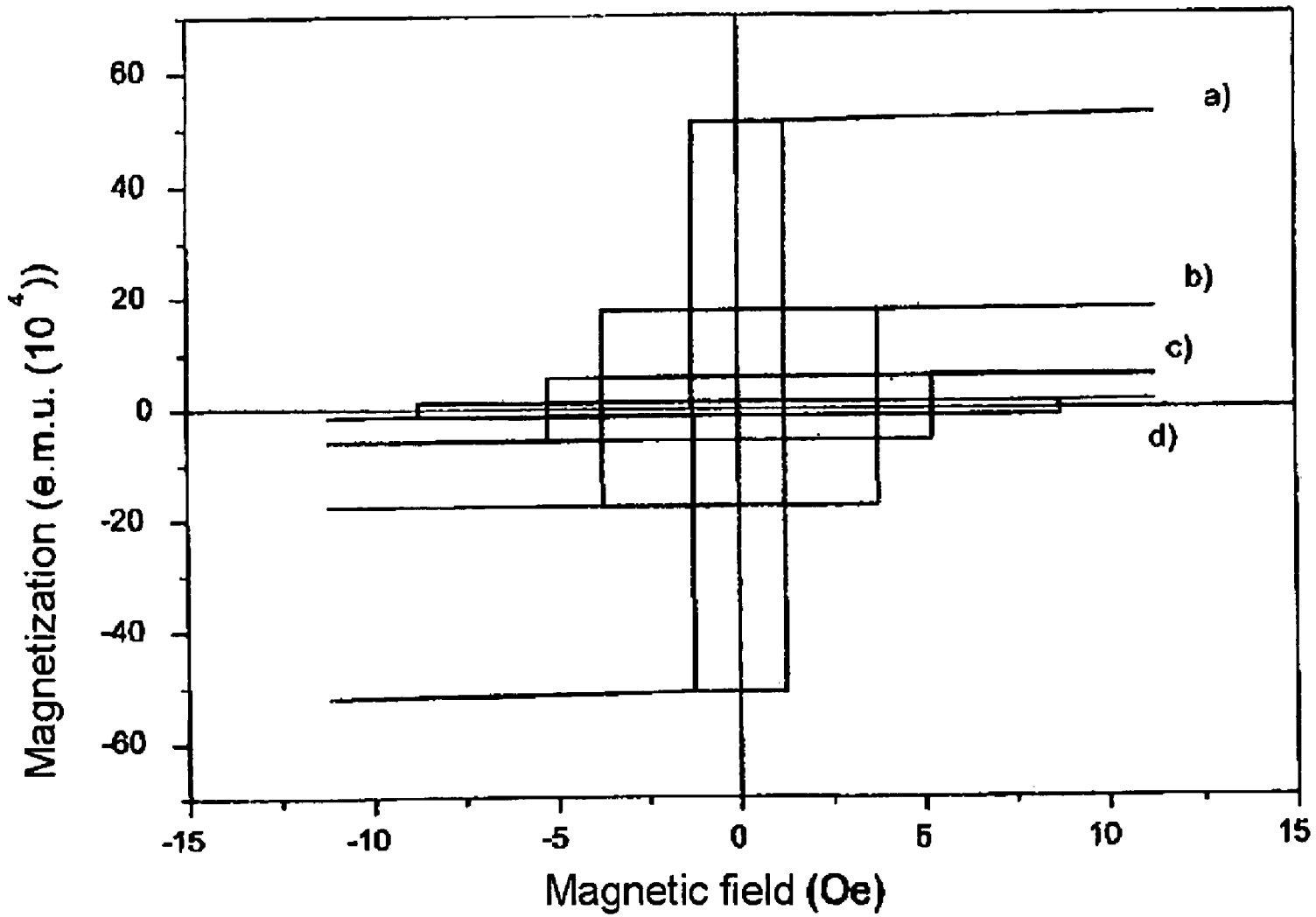
FIG. 2 shows the hysteresis loops associated to four microwires of FeSiBCMn composition.

FIG. 2 shows the hysteresis loops associated to four microwires, all with the FeSiBCMn composition. In them, the $D_c/D_t$ ratio varies in the following manner: 0.6 (a), 0.28 (b), 0.25 (c) and 0.2 (d); where $D_c$ is the metal core diameter and $D_t$ is the total diameter.

Figure 3:
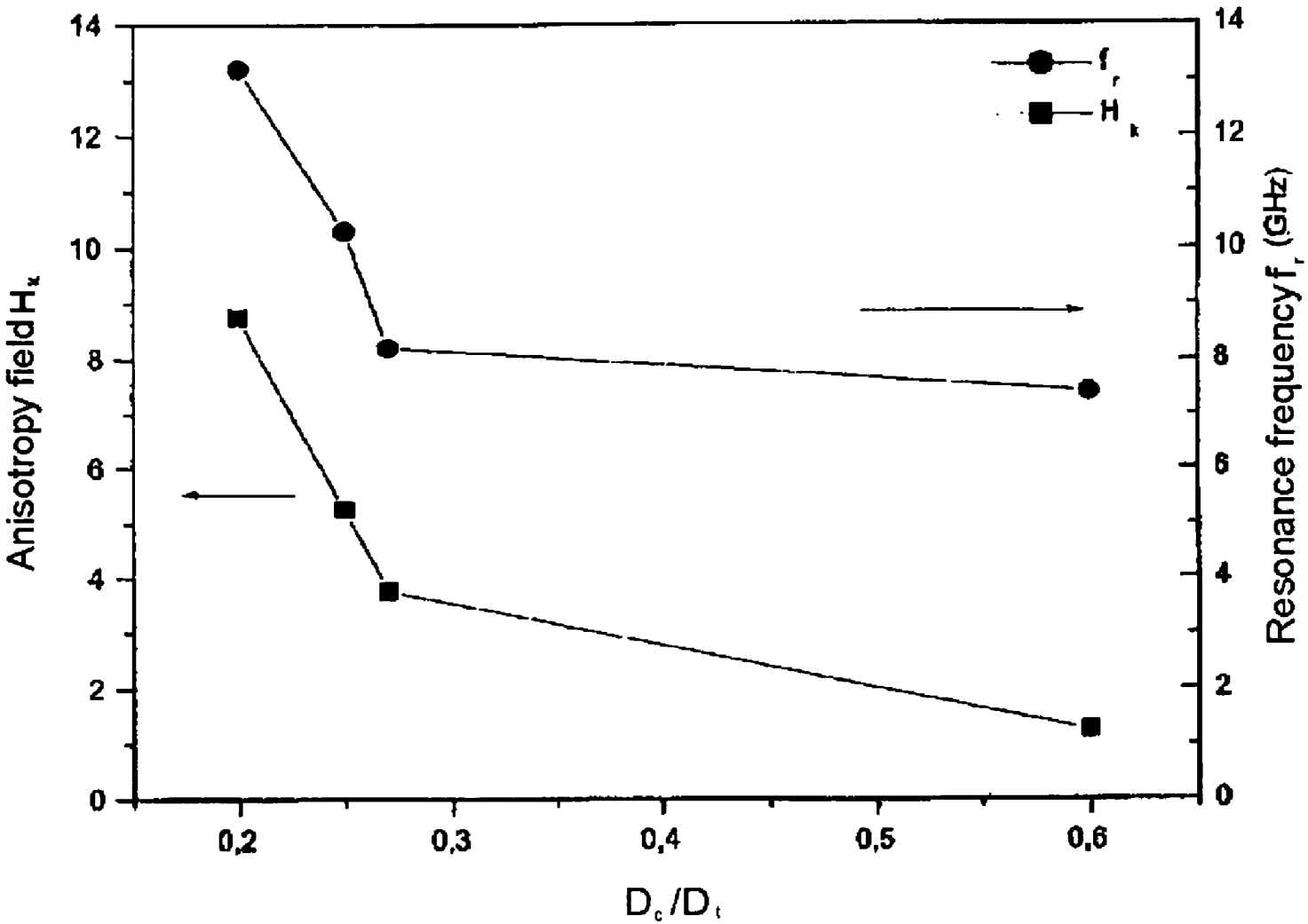
FIG. 3 shows the influence of the anisotropy field on the natural ferromagnetic resonance frequency.

Lastly, FIG. 3 shows the influence of the anisotropy field on the natural ferromagnetic resonance frequency, in relation to the ratio between the metal diameter and the total diameter of the microwires, the hysteresis loop of which is shown in FIG. 2.

The invention claimed is:

1. An amorphous microwire coated with an insulating sleeve, consisting of:

a metal core made up of an alloy of transition metals and metalloid elements, in a proportion between 65%–90% and 10%–35%, respectively, an insulating glass sleeve characterized in that the transition metals are at least iron, the relative proportion of iron being between 65%–100% of the total transition metals, and in that the core diameter ($D_c$) is comprised between 2 μm and 20 μm, such that the magnetostriction constant (λ) of the metal alloy is comprised between 1 and 30 ppm, and the natural ferromagnetic resonance frequency is comprised between 3 and 20 GHz.

2. A microwire according to claim 1, characterized in that the core diameter ($D_c$) is comprised between 2 μm and 10 μm.

3. A microwire according to claim 1, characterized in that the metalloid elements are manganese, silicon, boron and carbon.

4. A microwire according to claim 1, characterized in that the proportion of the core diameter ($D_c$) to the total diameter ($D_t$) of the microwire is comprised between 0.18 and 0.6.

5. A microwire according to claim 1, characterized in that the composition of the metal core is $Fe_{89}B_1Si_3C_3Mn_4$.

6. A microwire according to claim 1, characterized in that the composition of the metal core is $Fe_{69}B_{16}Si_{10}C_5$.

7. A microwire according to claim 1, characterized in that it has a bistable magnetic behavior.

8. A microwire according to claim 1, characterized in that it has an anisotropy field comprised between 0.5 and 10 Oe.

9. A microwire according to claim 1, characterized in that its natural ferromagnetic resonance frequency increases with the anisotropy field.

* * * * *